US011555302B2

(12) United States Patent
Kop

(10) Patent No.: US 11,555,302 B2
(45) Date of Patent: Jan. 17, 2023

(54) HEATED AND CHILLED WATER DISPENSER

(71) Applicant: XPRS Systems Pty Ltd, Red Hill (AU)

(72) Inventor: Trevor John Kop, Red Hill (AU)

(73) Assignee: XPRS Systems Pty Ltd, Red Hill (AU)

( * ) Notice: Subject to any disclaimer, the term of this patent is extended or adjusted under 35 U.S.C. 154(b) by 276 days.

(21) Appl. No.: 16/650,927

(22) PCT Filed: Sep. 25, 2018

(86) PCT No.: PCT/AU2018/051047
§ 371 (c)(1),
(2) Date: Mar. 26, 2020

(87) PCT Pub. No.: WO2019/060951
PCT Pub. Date: Apr. 4, 2019

(65) Prior Publication Data

US 2020/0270850 A1 Aug. 27, 2020

(30) Foreign Application Priority Data

Sep. 27, 2017 (AU) ..... 2017903920
Apr. 17, 2018 (AU) ..... 2018901279

(51) Int. Cl.
*E03C 1/044* (2006.01)
*B67D 1/08* (2006.01)
(Continued)

(52) U.S. Cl.
CPC ..... *E03C 1/044* (2013.01); *B67D 1/0857* (2013.01); *B67D 1/0895* (2013.01);
(Continued)

(58) Field of Classification Search
CPC ..... E03C 1/044; E03C 1/041; E03C 1/0411; B67D 1/0857; B67D 1/0895;
(Continued)

(56) References Cited

U.S. PATENT DOCUMENTS 5,766,453 A * 6/1998 Morellato ..... B01D 61/08 210/257.2
6,516,141 B1 * 2/2003 DeSantis ..... F24H 9/2021 392/441
(Continued)

FOREIGN PATENT DOCUMENTS

WO 1994020784 A1 9/1994

OTHER PUBLICATIONS

PCT; App. No. PCT/AU2018/051047; International Search Report and Written Opinion dated Dec. 19, 2018.
(Continued)

*Primary Examiner* — Patrick C Williams
(74) *Attorney, Agent, or Firm* — Fitch, Even, Tabin & Flannery, LLP

(57) ABSTRACT

A heated and chilled water dispenser comprising: a housing; an input port fast with the housing for connection to a mains pressure water supply; at least one chilled water container arranged to receive water from the input port; a water chilling assembly arranged to cool said at least one chilled water container; at least one hot water tank including a heating element and a water receiving arrangement to receive water from the input port, the water receiving arrangement including an inlet valve responsive to water level; an inlet plenum associated with the inlet valve, the plenum being coupled with the input port to receive water, the plenum further comprising a fill pipe coupled to the hot water tank for supplying water to the hot water tank; a thermostat coupled to said at least one hot water tank for controlling the heating element and thus temperature of water within the hot water tank; a two way outlet tap configured for dispensing hot water from the hot water supply or chilled water from the chilled water container in accordance with a user's selection; a liquid delivery device coupled to said at least one hot water tank for supplying hot
(Continued)

water from the hot water tank, said device being arranged to be actuated by the outlet tap.

17 Claims, 8 Drawing Sheets

(51) Int. Cl.
*F24D 17/00* (2022.01)
*F24H 9/20* (2022.01)
*E03C 1/04* (2006.01)
*F25D 31/00* (2006.01)

(52) U.S. Cl.
CPC ..... *F24D 17/0089* (2013.01); *F24H 9/2021* (2013.01); *E03C 1/041* (2013.01); *E03C 1/0411* (2013.01); *F25D 31/005* (2013.01)

(58) Field of Classification Search
CPC ..... B67D 2210/00118; F24D 17/0089; F25D 31/005; F24H 9/2021
See application file for complete search history.

(56) References Cited

U.S. PATENT DOCUMENTS

2006/0000851 A1* 1/2006 Girard ..... A47J 31/407 222/129.1
2011/0163116 A1* 7/2011 Dixon ..... B67D 1/0802 222/164
2013/0047631 A1 2/2013 Hung et al.
2013/0312426 A1 11/2013 Hung et al.
2015/0121616 A1* 5/2015 Peteri ..... E03C 1/0412 4/677
2016/0009537 A1* 1/2016 Orita ..... B67D 1/1202 222/144.5

OTHER PUBLICATIONS

PCT; App. No. PCT/AU2018/051047; International Preliminary Report on Patentability with Annexes dated Apr. 1, 2019.

* cited by examiner

HEATED AND CHILLED WATER DISPENSER

CROSS-REFERENCE TO RELATED APPLICATIONS

This application is a U.S. national phase application of International Application No. PCT/AU2018/051047, filed Sep. 25, 2018, which claims priority to Australian Application No. 2017903920, filed Sep. 27, 2017, and Australian Application No. 2018901279, filed Apr. 17, 2018.

TECHNICAL FIELD

The present invention relates to water dispensers that are configured to dispense hot water, for making hot beverages such as tea and coffee, and chilled water for drinking and making cold beverages

BACKGROUND

Any references to methods, apparatus or documents of the prior art are not to be taken as constituting any evidence or admission that they formed, or form part of the common general knowledge.

It is known in homes and offices for there to be a need for hot and chilled water. Hot water is required in order to make beverages such as tea and coffee. Chilled water is often sought out during summer time and may be drunk straight or added to cordials for example.

One type of known hot water dispenser 2 is illustrated in FIG. 1. Dispenser 2 comprises a push button valve 4 which is mounted to bench top 5 and which allows water from a connected water supply to pass from water inlet 6 through pipe 8 and into hot water tank 10. Subsequently, after electric heater 12 has heated the water in tank 10, further operation of the push button 4 will cause heated water within the tank 10 to proceed out through tap 14 whilst introducing further ambient temperature water into the bottom of the tank. The push button valve 4 incorporates a pressure reduction assembly so that water from the pressure push button 4 is at a reduced pressure relative to the mains water supply to which it is connected. The pressure reduction assembly is used so that the hot water leaving the tap 14 does not egress at a dangerously high velocity which could cause injury. Due to the pressure reduction the hot water system that is illustrated in FIG. 1 is effectively a vented hot water system.

It is desirable to provide a hot and chilled water dispenser that is energy efficient. It is also an object of the present invention to provide a compact chilled and hot water dispenser apparatus that is an improvement, or at least a useful commercial alternative, to those already known.

SUMMARY OF INVENTION

In an aspect, the invention provides a heated and chilled water dispenser comprising:

a housing;

an input port fast with the housing for connection to a mains pressure water supply;

at least one chilled water container arranged to receive water from the input port;

a water chilling assembly arranged to cool said at least one chilled water container;

at least one hot water tank including a heating element and a water receiving arrangement to receive water from the input port, the water receiving arrangement including an inlet valve responsive to water level;

an inlet plenum associated with the inlet valve, the plenum being coupled with the input port to receive water, the plenum further comprising a fill pipe coupled to the hot water tank for supplying water to the hot water tank;

a thermostat coupled to said at least one hot water tank for controlling the heating element and thus temperature of water within the hot water tank;

a two way outlet tap configured for dispensing hot water from the hot water supply or chilled water from the chilled water container in accordance with a user's selection;

a liquid delivery device coupled to said at least one hot water tank for supplying hot water from the hot water tank, said device being arranged to be actuated by the outlet tap.

In an embodiment, the dispenser further comprises a steam return line to return steam from the hot water tank to the plenum.

In an embodiment, the inlet valve is operated mechanically in response to changes in water level in the tank.

In an embodiment, the inlet valve operates in response to a float-type valve.

In an embodiment, the float-type valve is positioned in the plenum.

In an embodiment, the inlet plenum includes a steam release port.

In an embodiment, the fill pipe is metered or configured relative to heating capacity of the hot water tank.

In an embodiment, the liquid delivery device is a pump coupled to the outlet tap, the outlet tap further comprising an actuating arrangement whereby in at least one operable configuration the actuation arrangement actuates the liquid delivery device thereby delivering hot water from the tank to the outlet.

In an embodiment, the outlet tap comprises a tap body and a movable handle that is movable between a hot water dispensing open position, a chilled water dispensing open position and a closed position wherein a sensor is mounted in association with said movable handle to detect movement of said handle to the hot water dispensing open position, the sensor being coupled to the actuation arrangement to actuate the liquid delivery device.

In an embodiment, the sensor comprises: a magnetic member mounted to one of the tap body or the movable handle; and a pin mounted to the other of the tap body or the movable handle; whereby movement of the handle to the hot water dispensing open position results in contact between the magnetic member and the pin resulting in actuation of the liquid delivery device.

In an embodiment, the tap handle is operable to be:

turned in a first direction to the chilled water dispensing open position; and moved in an orthogonal direction relative to the first direction followed by turning the handle in a second direction to the hot water dispensing open position.

In an embodiment, the dispenser includes a temperature controller for the chilling assembly whereby operation of the chilling controller adjusts the operation of a condenser fan of said assembly.

In an embodiment, the housing includes vents formed through at least two of its sides for assisting the fan in cooling the condenser.

In an embodiment, the chilling assembly includes a temperature sensor that is coupled to the temperature controller for assisting in maintaining a desired chill temperature.

In an embodiment, at least one chilled water container comprises first and second containers that are connected in parallel to a chilled water output port of the dispenser.

In an embodiment, a filter is disposed in piping between the input port and the hot water tank and the at least one chilled water container.

In an embodiment, the housing is formed with a recess in which the filter is located.

In an embodiment, the recess is closed with a hinged cover.

In an embodiment, the dispenser includes controls mounted on a front panel of the housing for on/off power to the unit and for turning the heating element and chilling assembly on and off independently.

In an embodiment, the tap is configured to handle water temperatures up to 100 degrees Celsius at standard mains water pressure.

According to another aspect of the present invention there is provided a heated and chilled water dispenser comprising:

a housing;

an input port fast with the housing for connection to a mains pressure water supply;

at least one chilled water container arranged to receive water from the input port;

at least one unvented hot water tank including a heating element and arranged to receive water from the input port;

a water chilling assembly arranged to cool said at least one chilled water container;

a thermostat coupled to said at least one hot water tank for controlling the heating element and thus the water temperature of the tank; and a two-way outlet tap configured for dispensing mains pressure hot water from the hot water tank or mains pressure chilled water from the chilled water container in accordance with a user's selection.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
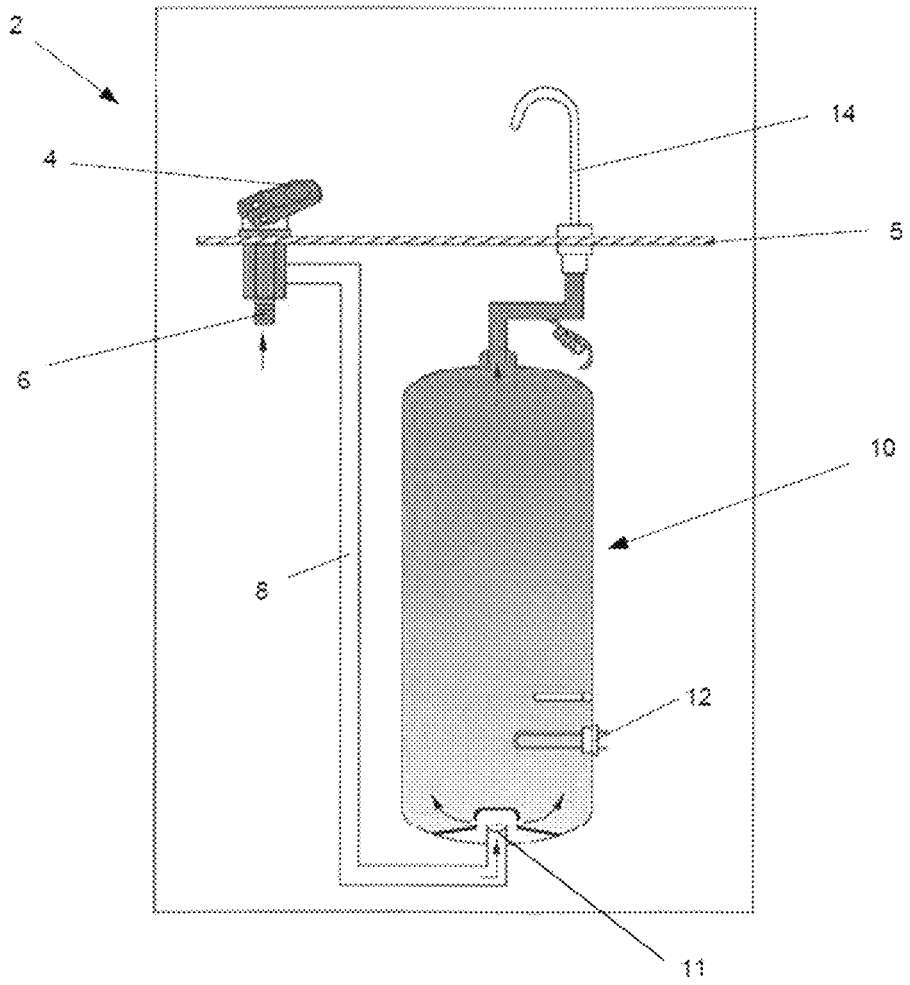
FIGURE 1 [Prior Art]
FIG. 1 is a schematic illustration of a hot water system 2 known from the prior art.

In a first embodiment of the invention, the invention provides a water heating sub-unit 100 for a water dispenser that may be used for a heated and chilled water dispenser. It is important to note that in at least some embodiments, the sub unit 100 may be used for dispensing heated water without including a water chilling functionality.

The water heating sub-unit includes a hot water tank 160 having an inlet plenum chamber 190. Inlet line 141 feeds water from a mains pressure supply (not shown) via a level control valve 192 which is mechanically controlled, here by float 194, to the plenum 190. The plenum 190 is in turn coupled to an upper portion of the hot water tank 160 both by a fill pipe 196 and by a steam return pipe 198, the latter allowing steam from tank 160 to flow to plenum tank 190. The returned steam can either cool and condense back to water and/or be released to atmosphere by a suitable gas port, such as an upstanding open tube (not shown) coupled to a top wall of the plenum tank. The returning steam provides additional thermal efficiency, in that the energy within the steam is recovered and aids in pre-heating water present in the plenum chamber 190.

Figure 2:
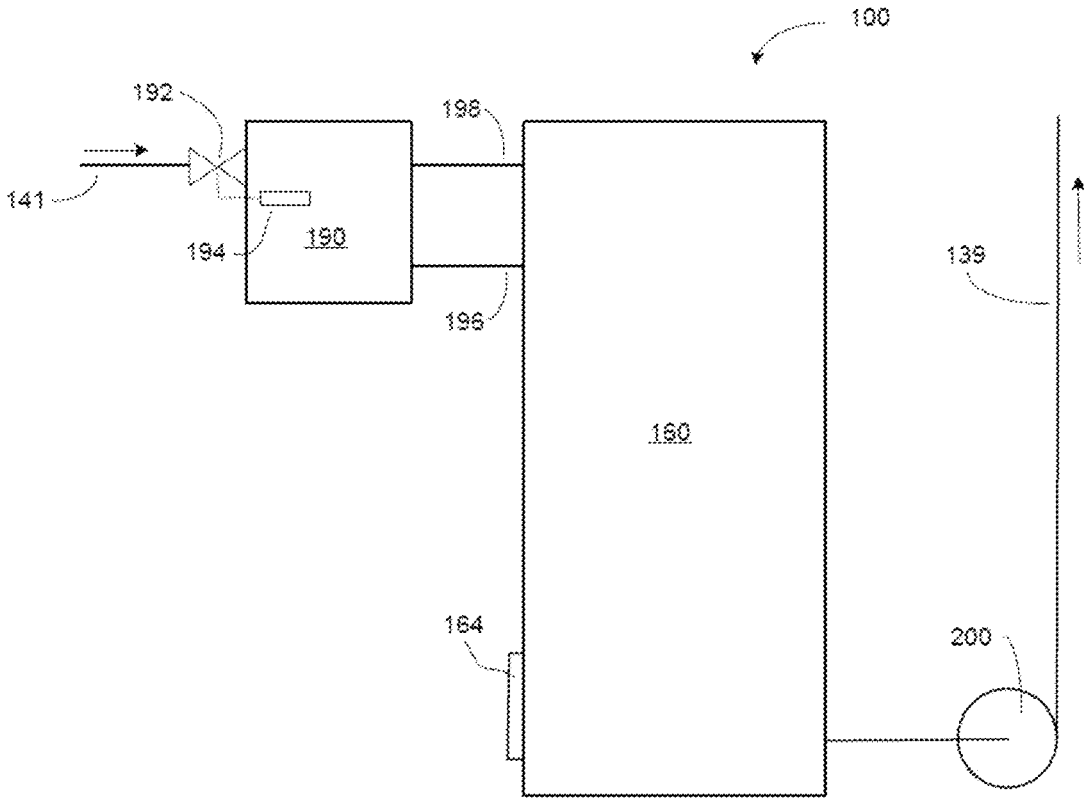
FIG. 2 is a schematic diagram of an alternative hot water tank and feed assembly in accordance with a further embodiment of the invention.

The tank 160, which operates at atmospheric pressure in the present embodiment, is further coupled at a lower end thereof by a feed pipe to a liquid delivery device here in the form of a pressure monitoring pump 200. The pump supplies hot water from the tank 160 to an outlet port such as a dispensing tap (not shown in FIG. 2) via conduit 139. The tank 160 of the present embodiment includes an internal heating element 165 and thermostat 164 for temperature control by controller 166, as will be described above in relation to another embodiment.

In use, the water heating sub-unit 100 of the further embodiment permits water to flow from mains supply via the valve 192 into plenum chamber 190 and, during filling when float 194 opens the valve, to flow on into tank 160 via fill pipe 196. When the water has reached a predetermined level in the tank 160, this will be reflected in the plenum water level, resulting in the float 194 closing valve 192. Upon a user manipulating a dispensing outlet tap connected to conduit 139 (such as tap 174 described in the foregoing sections) to select hot water. The tap 174 may be provided with an actuating arrangement (discussed in the foregoing sections), a pressure drop is sensed by pump 200 which then operates to supply hot water fed from tank 160 via conduit 139 to the outlet tap. When the water level drops below the predetermined level, as sensed by float 194 in plenum 190, the hot water tank 160 is able to be topped up from the mains flow through pipe 141.

It is anticipated that the water temperature in the hot water tank 160 will have a maximum of around 95° C. in view of the tank 160 being unpressurised, thereby minimising excessive release of steam via the gas port 198 is linked to the plenum chamber 190. This arrangement is believed to substantially reduce the risk of release of steam into a housing containing the water heating sub-unit 100 of the present embodiment. Simultaneously, energy efficiency is improved by recapture of heat from the steam returned to the plenum chamber 190 which assists with transferring some of the heat from the steam in the heating tank 160 to the water present in the plenum 190.

Figure 3:
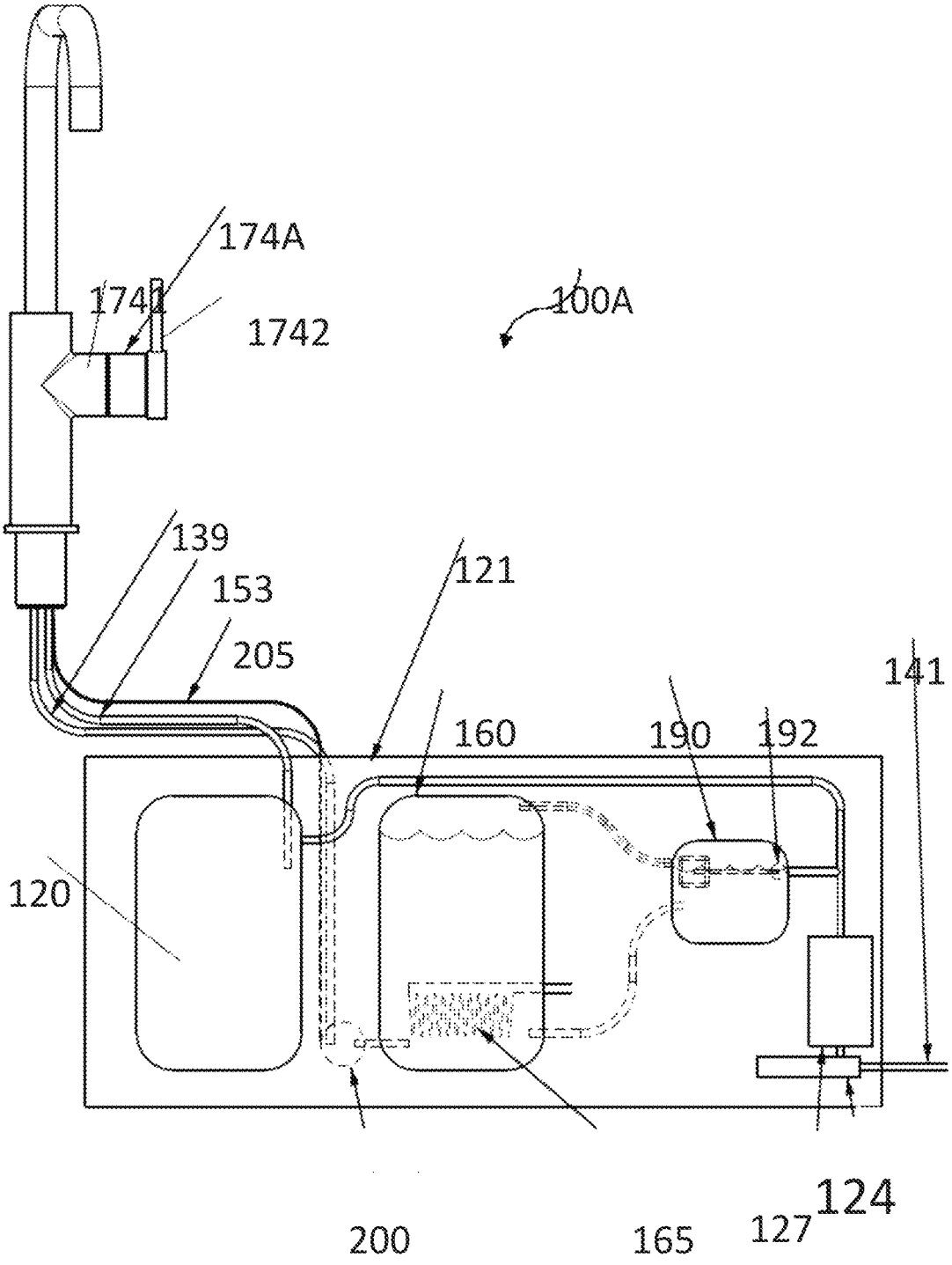
FIG. 3 is a schematic illustration of a hot water and chilled water dispenser according to an embodiment of the present invention utilising a first type of tap outlet 174A.
Figure 4:
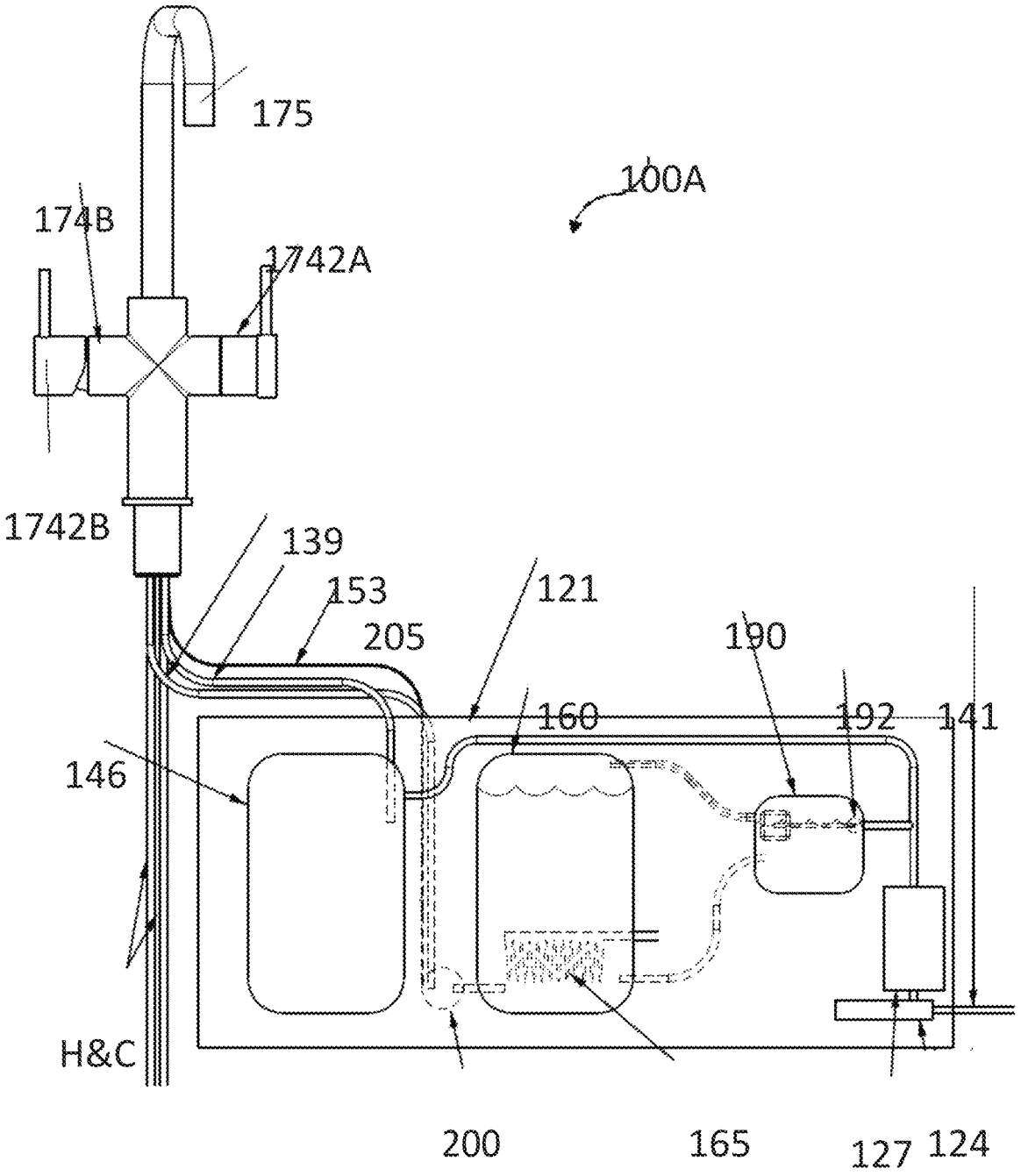
FIG. 4 is a schematic illustration of a hot water and chilled water dispenser according to an embodiment of the present invention utilising a first type of tap outlet 174B.

Referring now to FIGS. 3 and 4, schematic views of a compact heated and chilled water dispenser 100A have been illustrated. The dispenser 100A includes a chilled water container 120 and a water heating tank 160. The dispenser 100A comprises a housing 121 which encloses the various parts of the dispenser 100A. The dimensions of the housing 121 for the dispenser 100A are typically selected to allow the unit 100A to have a compact configuration such that the unit is sufficiently small to be readily transported and to be located underneath a kitchen bench for example. It will be realised that the dimensions of the unit 100A are non-limiting.

The top of the housing 121 may be provided with plumbing ports including a hot water (i.e. at boiling or near boiling) out port, chilled water out port and mains ambient water in port. The housing 121 that includes a hinged front door which can be swung out to reveal an internal replaceable water filter 124 which may be used for filtering mains water flowing into the dispenser 100A prior to being chilled or heated.

The system 100A may also be provided with a cold water temperature control dial and a hot water temperature control dial. As will be explained, the hot water temperature control dial may form a part of an electromechanical thermostat that is mounted to an internal hot water tank 160.

The dispenser system 100A may also be provided with a user control interface on the housing 121. The user control interface may include a Main Power On/Off button for connecting/disconnecting power from mains supply to the dispenser. The user control interface may also include a chiller power on/off two-colour button which shines blue when the internal chiller is operating. A water heater power on/off red button may also be provided with a red light that shines when the heating thermostat is operating while heating the water.

The schematic diagram shown in FIG. 3 represents the dispenser 100A being coupled with a tap outlet 174A that is adapted to be operated for dispensing chilled or boiling water thereby allowing two open positions. The schematic diagram shown in FIG. 4 represents the dispenser 100A being coupled with a tap outlet 174B that is adapted to be operated not only dispensing chilled or boiling water but to also allow water to be dispensed at mains line pressure (with no heating or cooling) and heated water (at temperatures lower than near boiling temperature) thereby allowing four open positions.

The following passages describe the working of the water dispenser 100A shown in FIGS. 3 and 4 in conjunction with tap outlets 174A and 1746. Like reference numerals denote like features which have been previously discussed in the earlier sections of the specification. The tap outlet 174A shown in FIG. 3 is fluidly coupled to the chilled water container 120 via fluid line 153 in order to convey cooled water from the chilled water container 120 to the outlet 174A. Similarly, tap outlet 174A shown is also fluidly coupled to the hot water tank 160 via fluid line 139 in order to convey heated water at near oiling temperature from the hot water tank 160 to the outlet 174A.

Figure 5:
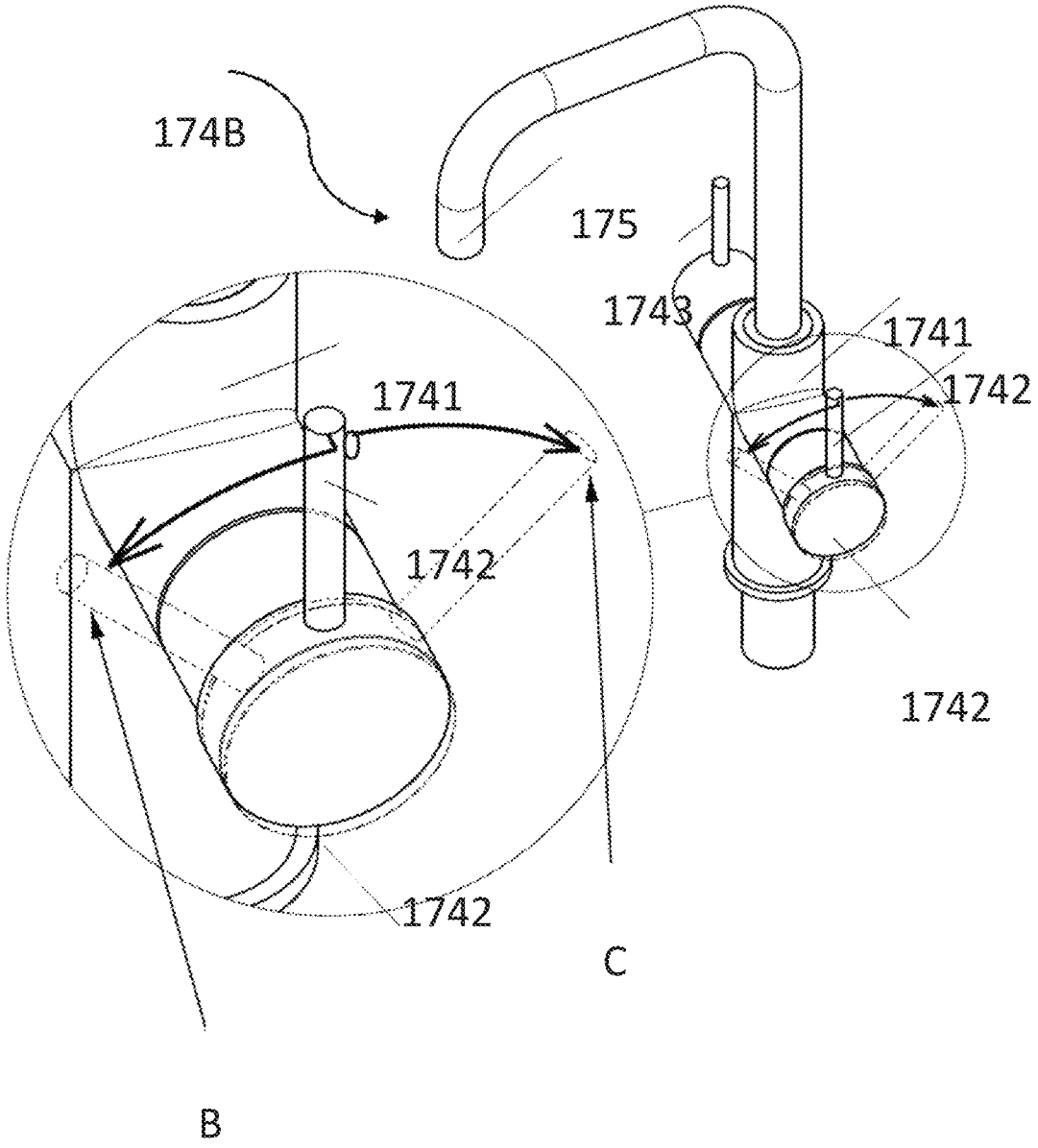
FIG. 5 is a perspective view of the tap outlet 174B showing various operable positions.

Each of the tap outlets 174A and 174B includes an actuating arrangement whereby in one operable configuration the actuation arrangement actuates the pump 200 to deliver hot water from the tank 160 to the tap outlet 174A and 174B. Both outlet taps 174A and 174B include a tap body 1741 and a movable handle 1742 that is movable between a hot water dispensing open position (denoted by B), a chilled water dispensing open position (denoted by C) and a closed position (denoted by O) as best shown in FIG. 5. In the preferred embodiment, the tap handle 1742 may be provided with a usersafety feature to prevent accidental dispensing of hot water at near boiling temperature. As operable to be turned in a first direction (turn right-as viewed by the user) to the chilled water dispensing open position (denoted by C); and moved in an orthogonal direction relative to the first direction (pulled towards the user) followed by turning the handle in a second direction (turn left-as viewed by the user) to the hot water dispensing open position (B).

Figure 6:
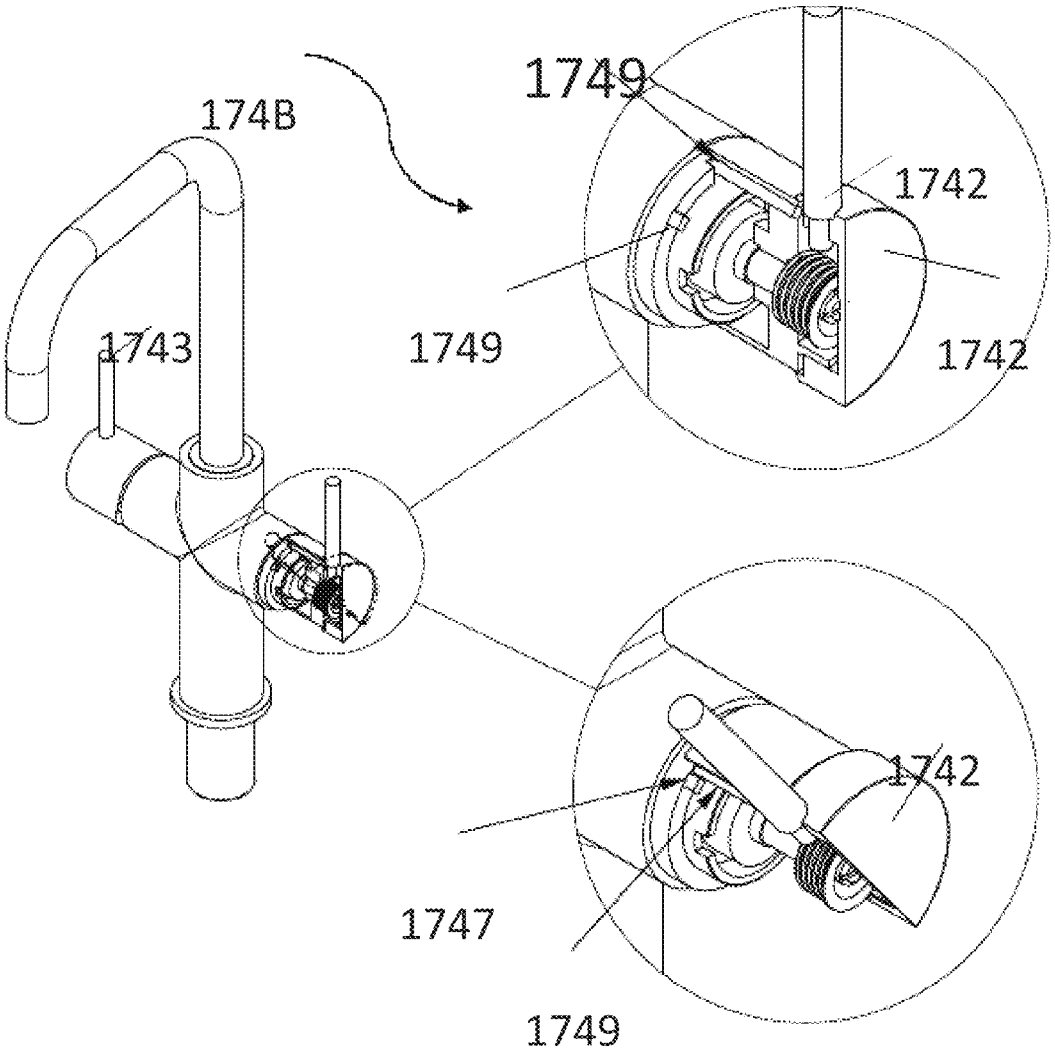
FIG. 6 is a perspective view of the tap outlet 174B with internal views of the tap body.

In both taps 174A and 174B, a sensor is mounted in association with said movable handle 1742 to detect movement of the handle 1742 to the hot water dispensing open position (denoted by B), the sensor being coupled to the actuation arrangement to actuate the pump 200. In the preferred embodiment as illustrated in FIG. 6, the sensor comprises: a magnetic member in the form of a magnetic proximity switch 1747 mounted to the tap body 1741 and a pin 1749 built into a sleeve of the movable handle 1742. Movement of the handle to the hot water dispensing open position results in actuation of the magnetic proximity switch 1747. The magnetic proximity switch 1747 is electrically connected to the pump 200 via electrical line 205 (See FIGS. 3 and 4). As a result, actuation of the magnetic proximity switch 1747 by movement of the handle triggers the pump 200 thereby resulting in hot water being pumped from the hot water tank 160 the tap outlets 174A and 174B. The pulling of the handle 1741 in an orthogonal direction towards the user, as described in the previous paragraph, allows the pin 1749 to clear a space that is provided between the magnetic proximity switch 1747 and the pin 1749. Puling of the handle 1742 followed by turning of the handle 1742 results in the pin 1749 contacting the proximity switch 1747. It is important to appreciate that in the present embodiment, the handle 1742 cannot be turned to the open hot water dispensing position (B) without initially pulling the handle 1742. The requirement to initially pull the handle 1742 followed by turning the tap handle 1742 for dispensing hot water (at nearly boiling temperature) requires a compound movement by the user involving movement in at least two different directions which in turn provides a user safety functionality preventing users from accidentally activating the outlet tap 174A or 174B.

Figure 7:
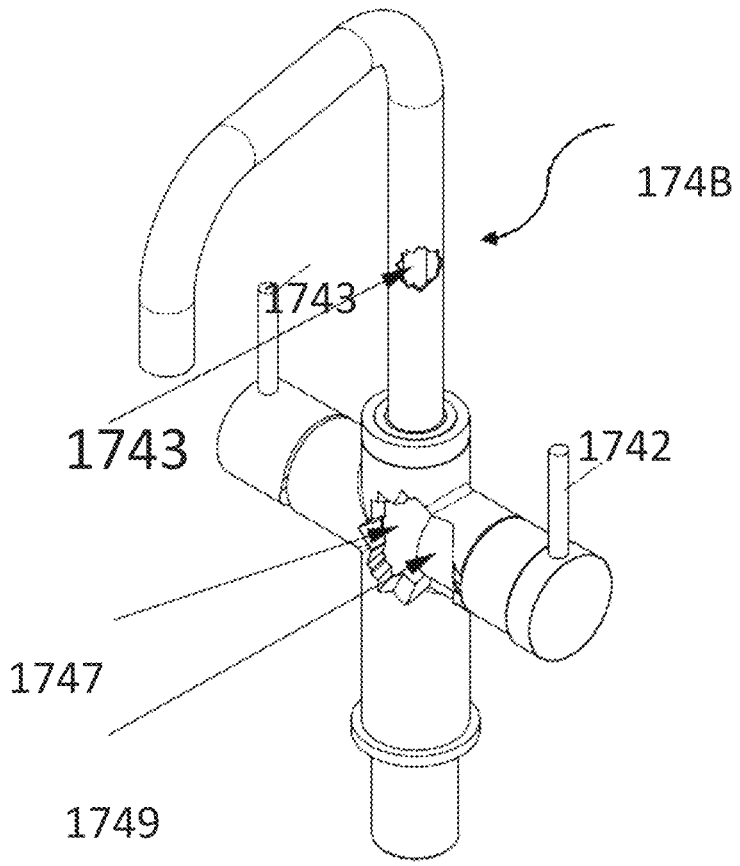
FIG. 7 is another perspective view of the tap outlet 174B internal views of the insulation used in the tap outlet 174B.

As shown in FIG. 7, the taps 174A and 174B also include insulated tubes 1743 formed from an insulting material such as Teflon to prevent the spout 175 from being overheated. The taps 174A and 174B may also include an insulating manifold 1747 and an insulating shell 1749 made from an insulating material such as Teflon to prevent the tap outlet body from being too hot to touch during prolonged use.

Unlike outlet tap 174A, outlet tap 174B is also adapted to dispense water at mains pressure (without heating or cooling) and heated water (at a lower temperature than near boiling temperature). Additional fluid lines H and C (shown in FIG. 4) may be directly coupled to the outlet tap 174B. A second rotatable handle 1743 (see FIGS. 4, 6 and 7) is provided for controlling flow of water in these two additional water dispensing configurations.

Figure 8:
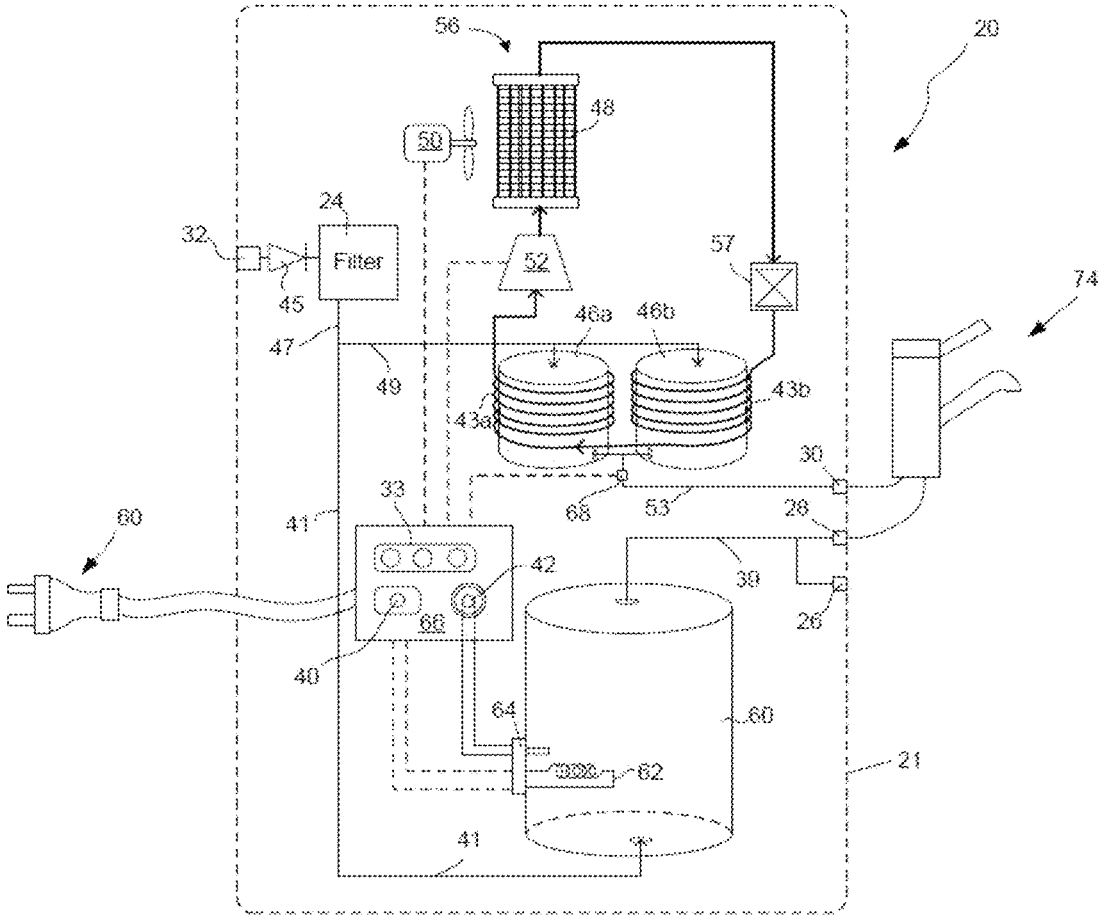
FIG. 8 is a diagram of a dispenser in accordance with an embodiment of the invention.

Referring to FIG. 8, a block diagram for another embodiment of the present invention in the form of a dispenser 20 is illustrated. the dispenser 20 includes a check valve 45 which allows unidirectional flow from inlet port 32 to filter 24. The output side of filter 24, which is at mains pressure, is coupled by means of pipes 47, 49 to cold water tanks 46*a*, 46*b*. The tanks 46*a*, 46*b* have outlets that are coupled to chilled water outlet port 30 via piping 53.

A water chilling assembly 56 is provided that includes series connected evaporator coils 43*a*, 43*b* which are respectively coiled about chilled water tanks 46*a* and 46*b* to draw heat therefrom in use. The water chilling assembly 56 further comprises a compressor 52 which forces vaporised refrigerant from evaporator coil 43*a* through condenser 48. Compressor 52 raises the pressure of the refrigerant and forces it through the condenser 48, where it condenses to liquid form thereby giving off heat in the process. The refrigerant is cooled in the condenser by ambient air from condenser fan 50. Air flow through the chassis is facilitated by means of air vents formed through opposed sides of the housing 21. The cooled condensed refrigerant then passes through expansion valve 57 where it experiences a pressure drop and temperature drop. The cooled refrigerant passes through evaporator coils 43*a*, 43*b* thereby drawing heat from water in tanks 46*a* and 46*b* and thereby chilling the water, which is temperature adjusted by means of controller dial 40.

The dispenser 20 further includes an unvented hot water tank 60. Which is fitted with an electric heating element 62 and electromechanical thermostat 64. The thermostat 64 may be temperature adjusted by means of dial 42. Mains pressure water from filter 24 fills the tank 60 via pipe 41. The tank 60 has an outlet by which hot water from tank 60 is conveyed to hot water outlet 28 and steam outlet 26 via pipe 39.

The dispenser 20 includes a controller assembly 66 which receives mains electrical power from a general purpose outlet (GPO) via GPO plug 60. The controller assembly 66 distributes electrical power to the heating element 62 and also to condenser fan 50 and chiller compressor 52. The controller assembly 66 includes hot water control dial 42, which is part of thermostat 64 and cold water temperature control 40. The cold water temperature control 40 allows a user to set a desired temperature for the chilled water in tanks 46*a*, 46*b*. The temperature control 40 monitors the temperature from the water tanks 46*a*, 46*b* by means of sensor 68 and adjusts the speed of the condenser fan 50 in response to increase or decrease the effect of the condenser 48 and thus the cooling of tanks 46*a*, 46*b* in order to attain the target temperature.

In use the dispenser 20 may be located on a shelf beneath a bench top. The hot and chilled water ports 30, 28 are piped to a mechanically operated valve tap 74. Mains supply is piped from outlet 76 to inlet port 32 and the steam outlet 26 is piped to waste via outlet tube 78. The power plug 60 is plugged into a domestic general purpose electrical outlet 80. A user may then operate the buttons on interface 33 to switch the dispenser on and to power up the heating element for the hot water tank and the chilling assembly for the water tanks. As the mains supply is connected the hot water tank and the chilled water containers fill so that air initially passes out through the tap 74 which is deliberately brought to an open position for each of the hot water and chilled water supplies from the dispenser. The tap 74 is then closed until the water in the chilled water containers cool to the temperature that is set by chiller control 40 and the water in the hot water tank is brought up to the temperature that is set by the thermostat dial 42. The respective centre power light indicators 34 and 36 will switch off when the set temperatures are reached with the outer rims remaining illuminated to show that the required temperatures have been attained.

Subsequently, once the desired hot and chilled water temperatures have been achieved, a user may dispense hot or chilled water through tap 74 at up to mains pressure.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

The invention claimed is:

1. A heated and chilled water dispenser comprising:

a housing;

at least one chilled water container;

a hot water tank assembly comprising an inlet plenum chamber and at least one hot water tank, the at least one hot water tank comprising a heating element;

an inlet line having a level control valve, the inlet line connectable to a mains pressure water supply and configured to deliver water to the at least one chilled water container and the inlet plenum chamber;

a fill pipe connecting the at least one hot water tank and the inlet plenum chamber for supplying water from the inlet plenum chamber to the at least one hot water tank;

a steam return pipe connecting the at least one hot water tank and the inlet plenum chamber for returning steam from the at least one hot water tank to the inlet plenum chamber;

a thermostat coupled to the at least one hot water tank for controlling the heating element and thus temperature of water within the at least one hot water tank;

a two way outlet tap configured for dispensing hot water from the at least one hot water tank or chilled water from the at least one chilled water container in accordance with a user's selection; and a liquid delivery device coupled to the at least one hot water tank for supplying hot water from the at least one hot water tank, said device being arranged to be actuated by the outlet tap;

wherein the inlet line feeds water from the mains pressure supply via the level control valve which is mechanically controlled by a float within the inlet plenum chamber.

2. The heated and chilled water dispenser in accordance with claim 1 wherein the level control valve is operated mechanically in response to changes in water level in the at least one hot water tank.

3. The heated and chilled water dispenser in accordance with claim 1 wherein the inlet plenum chamber includes a steam release port.

4. The heated and chilled water dispenser in accordance with claim 1 wherein the fill pipe is metered or configured relative to heating capacity of the at least one hot water tank.

5. The heated and chilled water dispenser in accordance with claim 1 wherein the liquid delivery device is a pump coupled to the outlet tap, the outlet tap further comprising an actuating arrangement whereby in at least one operable configuration the actuation arrangement actuates the liquid delivery device thereby delivering hot water from the at least one hot water tank to the outlet tap.

6. The heated and chilled water dispenser in accordance with claim 5 wherein the outlet tap comprises a tap body and a movable handle that is movable between a hot water dispensing open position, a chilled water dispensing open position and a closed position wherein a sensor is mounted in association with said movable handle to detect movement of said handle to the hot water dispensing open position, the sensor being coupled to the actuation arrangement to actuate the liquid delivery device.

7. The heated and chilled water dispenser in accordance with claim 6 wherein the sensor comprises:

a magnetic member mounted to one of the tap body or the movable handle; and a pin mounted to the other of the tap body or the movable handle;

whereby movement of the handle to the hot water dispensing open position results in contact between the magnetic member and the pin resulting in actuation of the liquid delivery device.

8. The heated and chilled water dispenser in accordance with claim 6 wherein the movable handle is operable to be:

turned in a first direction to the chilled water dispensing open position; and moved in an orthogonal direction relative to the first direction followed by turning the movable handle in a second direction to the hot water dispensing open position.

9. The heated and chilled water dispenser according claim 1 including a water chilling assembly having a temperature controller whereby operation of the temperature controller adjusts the operation of a condenser of said water chilling assembly.

10. The heated and chilled water dispenser according to claim 9, wherein the housing includes vents formed through at least two of its sides for assisting the fan in cooling the condenser.

11. The heated and chilled water dispenser according to claim 9, wherein the chilling assembly includes a temperature sensor that is coupled to the temperature controller for assisting in maintaining a desired chill temperature.

12. The heated and chilled water dispenser according to claim 1, wherein the at least one chilled water container comprises first and second containers that are connected in parallel to a chilled water output port of the dispenser.

13. The heated and chilled water dispenser according to claim 1, wherein a filter is disposed in piping between the input port and the hot water tank and the at least one chilled water container.

14. The heated and chilled water dispenser according claim 13, wherein the housing is formed with a recess in which the filter is located.

15. The heated and chilled water dispenser according to claim 14, wherein the recess is closed with a hinged cover.

16. The heated and chilled water dispenser according to claim 1, including controls mounted on a front panel of the housing for on/off power to the unit and for turning the heating element and chilling assembly on and off independently.

17. The heated and chilled water dispenser according to claim 1 wherein the tap is selected to handle water temperatures up to 100 degrees Celsius at standard mains water pressure.

* * * * *